US006139173A

United States Patent [19]

Hanamori

[11] Patent Number: 6,139,173

[45] Date of Patent: Oct. 31, 2000

[54] VEHICULAR LAMP

[75] Inventor: Kazuhiro Hanamori, Shizuoka, Japan

[73] Assignee: Koito Manufacturing Co., Ltd., Tokyo, Japan

[21] Appl. No.: 09/253,728

[22] Filed: Feb. 22, 1999

[30] Foreign Application Priority Data

Mar. 5, 1998 [JP] Japan ..... 10-053290

[51] Int. Cl.[7] ..... F21W 101/10; F21V 5/00

[52] U.S. Cl. ..... 362/522; 362/309; 362/329; 362/332; 362/336

[58] Field of Search ..... 362/522, 520, 362/332, 335, 336, 338, 329, 309

[56] References Cited

U.S. PATENT DOCUMENTS

| | | | |
|---|---|---|---|
| 2,767,306 | 10/1956 | Gaither et al. | 362/522 X |
| 4,332,438 | 6/1982 | Green | 362/388 X |
| 4,849,861 | 7/1989 | Arima | 362/61 |
| 4,855,877 | 8/1989 | Otaka | 362/61 |
| 4,868,725 | 9/1989 | Sakagawa et al. | 362/231 |
| 5,001,610 | 3/1991 | Otaka | 362/61 |
| 5,398,137 | 3/1995 | Ishikawa et al. | 359/742 |
| 5,526,247 | 6/1996 | Sigiyama | 362/268 |
| 5,548,498 | 8/1996 | Murakami | 362/336 |
| 5,556,194 | 9/1996 | Natsume et al. | 362/299 |
| 5,580,165 | 12/1996 | Natsume et al. | 362/331 |
| 5,582,481 | 12/1996 | Natsume | 362/336 |
| 5,603,561 | 2/1997 | Ohishi | 362/80 |
| 5,603,563 | 2/1997 | Natsume | 362/309 |
| 5,658,072 | 8/1997 | Natsume et al. | 362/331 |

FOREIGN PATENT DOCUMENTS

| | | | |
|---|---|---|---|
| 2610083 | 7/1988 | France | 362/522 |

*Primary Examiner*—Laura K. Tso
*Attorney, Agent, or Firm*—Morgan, Lewis & Bockius LLP

[57] ABSTRACT

A vehicular lamp including a lamp body having a U-shaped recess portion defining a lamp chamber and an opening; a light source disposed in the lamp chamber; a lens covering the opening of the lamp body; a fish-eye lens portion formed of at least one fish-eye lens; a cylindrical lens portion formed of at least one cylindrical lens, the fish-eye lens portion and the cylindrical lens portion arranged on a surface of the lens with a thickness of the fish-eye lens portion being substantially equal to a thickness of the cylindrical lens portion.

20 Claims, 5 Drawing Sheets

VEHICULAR LAMP

This application claims the benefit of Japanese Patent Application No. Hei. 10-053290, filed in Japan on Mar. 5, 1998, which is hereby incorporated by reference.

BACKGROUND OF THE INVENTION

1. Field of the Invention

The present invention relates to a vehicular lamp for a motor vehicle and, more particularly, to a method for preventing a deformation (or dent) in the lens created during formation of lenses having a fish-eye lens portion and a cylindrical lens portion.

2. Discussion of the Related Art

A vehicular lamp, such as a vehicular marker lamp, for a motor vehicle has a lens with a fish-eye lens portion formed of a fish-eye lens and a cylindrical lens portion formed of a cylindrical lens. Because the thickness of the fish-eye lens portion and the cylindrical lens portion in a conventional lens as described is different, the cooling period for the respective portions during formation accordingly differs. This may deform the resultant lens, thereby creating the so called dent.

SUMMARY OF THE INVENTION

Accordingly, the present invention is directed to a vehicular lamp that substantially obviates one or more of the problems due to limitations and disadvantages of the related art.

An object of the present invention is to prevent generation of the dent in the shape of the lens during formation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a vehicular lamp includes a lamp body having a U-shaped recess portion defining a lamp chamber and an opening; a light source disposed in the lamp chamber; a lens covering the opening of the lamp body; a fish-eye lens portion formed of at least one fish-eye lens; a cylindrical lens portion formed of at least one cylindrical lens, the fish-eye lens portion and the cylindrical lens portion arranged on a surface of the lens with a thickness of the fish-eye lens portion being substantially equal to a thickness of the cylindrical lens portion.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 3A is an enlarged rear elevation and FIG. 3B is an enlarged section, respectively;

FIG. 4A is an enlarged rear elevation and FIG. 4B is an enlarged section, respectively;

FIG. 5A is an enlarged rear elevation and FIG. 5B is an enlarged section, respectively;

DETAILED DESCRIPTION OF THE PREFERRED EMBODIMENTS

Reference will now be made in detail to the preferred embodiments of the present invention, examples of which are illustrated in the accompanying drawings.

As will be explained in detail below, each of the fish-eye lens portions and cylindrical lens portions in a vehicular lamp lens for the vehicular lamp according to preferred embodiments of the present invention have a substantially equal thickness. As a result, since each of the fish-eye lens portions and cylindrical lens portions in the vehicular lamp lens of the present invention have substantially equal thicknesses, the deformation or dent in the lens shape is prevented during formation of the lens.

Figure 1:
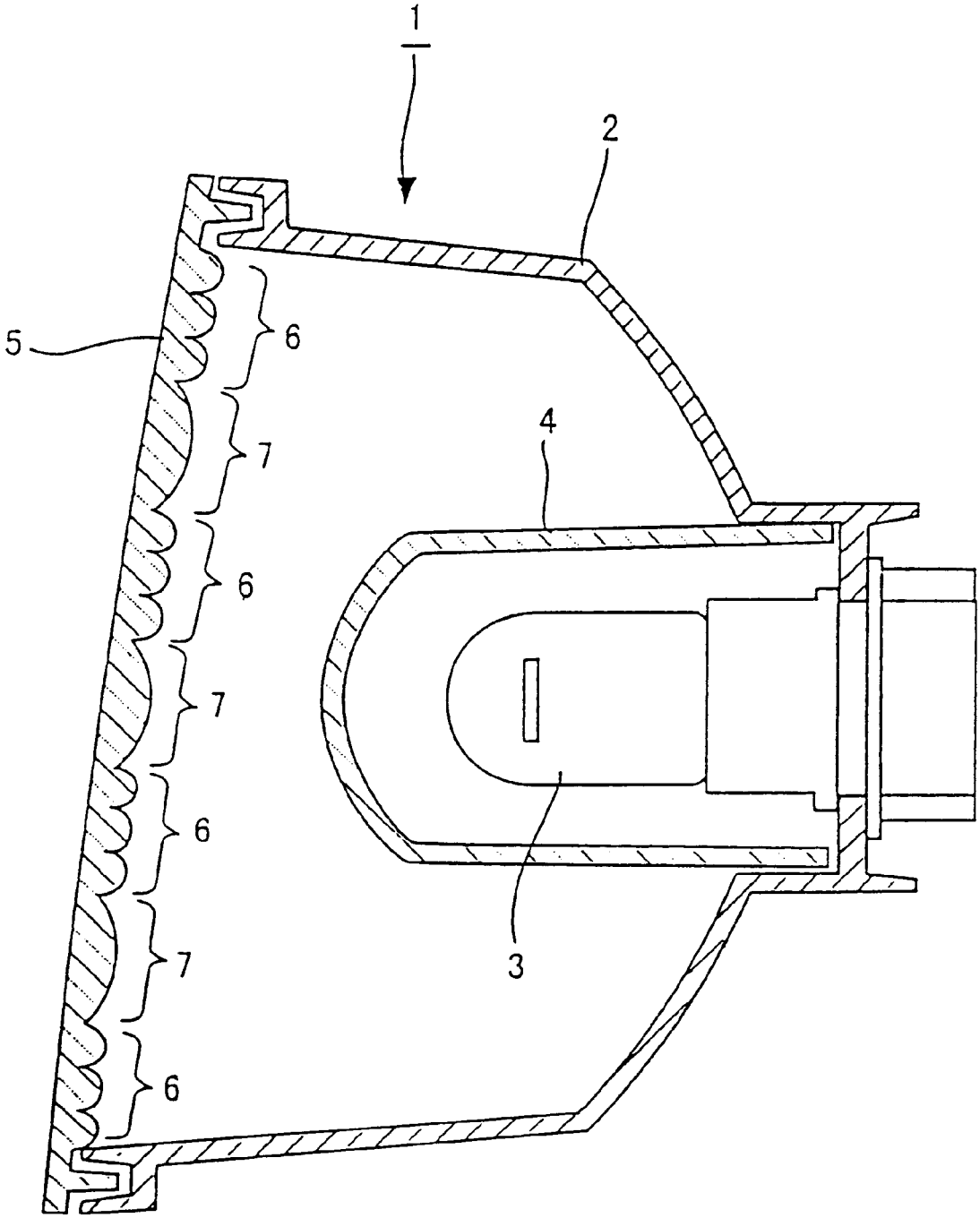
FIG. 1 is a vertical cross-sectional view of a first embodiment of the present invention.
Figure 2A:
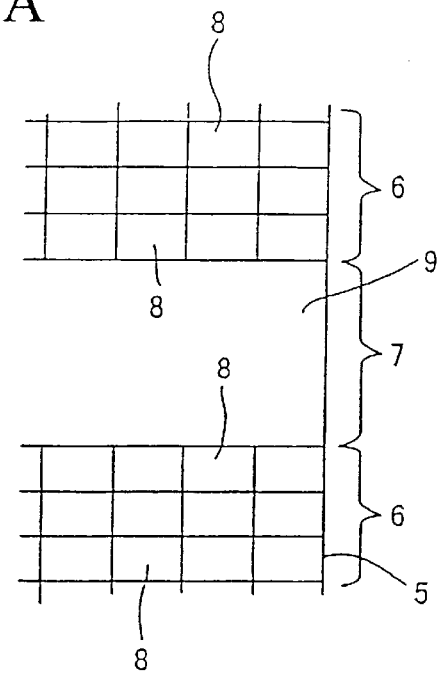
FIGS. 2A and 2B illustrate a portion of the lens of FIG. 1 where FIG. 2A lens is an enlarged rear elevation and FIG. 2B is an enlarged section, respectively.
Figure 2B:
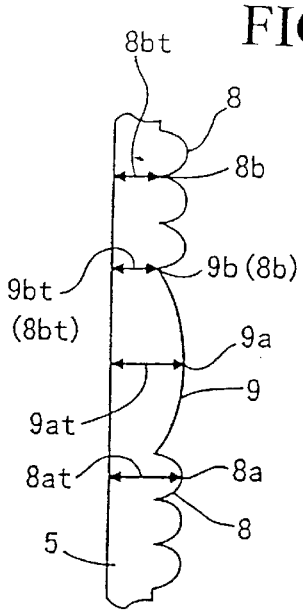

FIGS. 1, 2A, and 2B illustrate a first embodiment by applying the present invention to a vehicular marker lamp for a motor vehicle.

A vehicular marker lamp 1 includes a lamp body 2 having a U-like shaped recess portion with an open front. A bulb 3 is attached to the center of the rear end of the lamp body 2 as a light source. The bulb 3 is surrounded by a glove 4 for coloring effects. A lens 5 is attached to the lamp body 2 to cover the open front of the lamp body 2. The lens 5 is preferably formed of a transparent thermoplastic synthetic resin, such as polycarbonate, acrylic resin or the like. In addition, fish-eye lens portions 6 and cylindrical lens portions 7 are alternately arranged on the inner surface of the lens 5.

The fish-eye lens portion 6 is formed of a plurality of fish-eye lenses 8 as shown in FIGS. 2A and 2B each formed as a convex lens defining a substantially semi-spherical shaped projection. The cylindrical lens portion 7 is formed of a cylindrical lens 9 as a convex lens defining a dome-shaped strip projection.

Each thickness of the fish-eye lens portion 6 and the cylindrical lens portion 7 of the lens 5 is substantially equal. That is, the thickness 8*at* of the fish-eye lens 8*at* bottoms 8*b* of the fish-eye lens portion 6 defined by the top portion thereof 8*a* and the surface of the lens 5 is substantially equal to the thickness 9*at* of the cylindrical lens 9 of the cylindrical lens portion 7 defined by the top portion thereof 9*a* and the surface of the lens 5. Each thickness 8*bt* defined by the surface of the lens 5 and the boundary between adjacent fish-eye lenses 8 is substantially equal to each thickness 9*bt* defined by the surface of the lens 5 and the boundary between the fish-eye lens 8 and the cylindrical lens 9 adjacent thereto.

In the aforementioned vehicular marker lamp 1, as the lens 5 is formed of the fish-eye lens portions 6 and the cylindrical lens portions 7 such that each lighting image derived therefrom may vary, thus providing unique impression. Additionally, the thickness of each of the fish-eye lens portions 6 and cylindrical lens portions 7 is substantially equal. As a result, the difference in the cooling times during formation of the lens 5 for the two portions is minimal, thereby preventing the generation of a dent during formation of the lens.

Figure 3A:
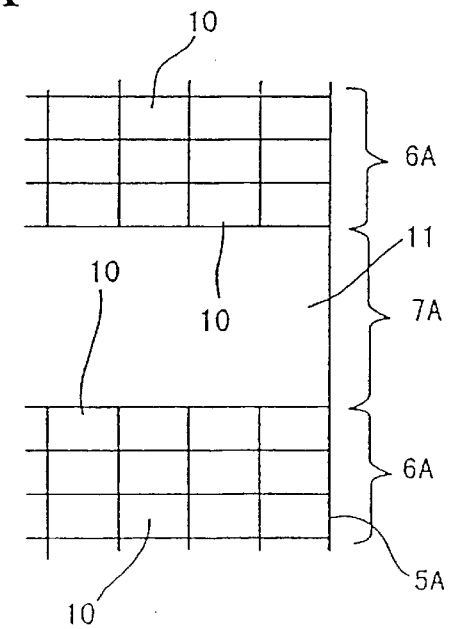
FIGS. 3A and 3B illustrate a second embodiment where
Figure 3B:
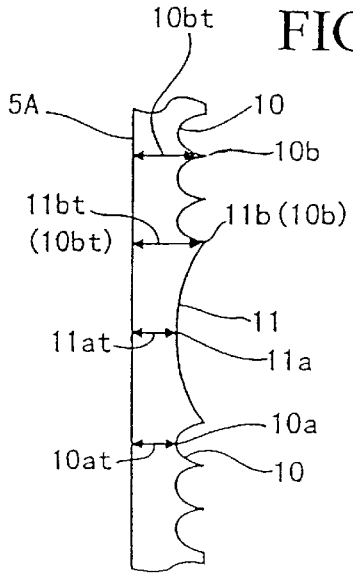

FIGS. 3A and 3B illustrate a second embodiment of the vehicular lamp of the present invention.

The second embodiment is similar to the first embodiment except that the fish-eye lenses and the cylindrical lenses constituting the lens are combined in a different manner. Since the other parts of the second embodiment are similar to those of the first embodiment, only the different parts will be described with reference to the drawings. This applies to the following third to fifth embodiments of the present invention.

In the second embodiment, a lens 5A is formed of fish-eye lens portions 6A and cylindrical lens portions 7A which are alternately arranged. The fish-eye lens portion 6A is formed of a plurality of fish-eye lenses 10. Each fish-eye lens 10 is formed as a concave lens defining a semi-spherical recess. Meanwhile, the cylindrical lens portion 7A is formed of a cylindrical lens 11 as a concave lens defining a dome-shaped strip recess.

The thickness of each fish-eye lens portion 6A and the cylindrical lens portion 7A in the lens 5A is substantially equal. That is, a thickness 10*at* defined by a surface of the lens 5A and the bottom 10*a* of the fish-eye lens 10 of the fish-eye lens portion 6A is substantially equal to the thickness 11*at* defined by the surface of the lens 5A and the bottom 11*a* of the cylindrical lens 11 of the cylindrical lens portion 7A. The thickness 10*bt* defined by the surface of the lens 5A and the boundary between adjacent fish-eye lenses 10 is substantially equal to the thickness 11*bt* defined by the surface of the lens 5A and the boundary 11*b* (or 10*b*) between the fish-eye lens 10 and the cylindrical lens 11 adjacent thereto.

In the second embodiment, the respective lighting images derived from the fish-eye lens portions 6A and the cylindrical lens portions 7A of the lens 5A may vary, thereby providing unique impression. Because the thickness of each fish-eye lens portions 6A and each cylindrical lens portions 7A is substantially equal, the dent in the shape of the lens 5A can be prevented during formation of the lens 5A.

Figure 4A:
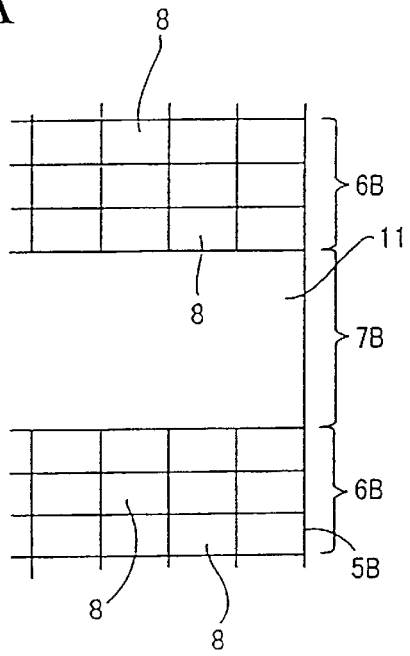
FIGS. 4A and 4B illustrate a third embodiment where
Figure 4B:
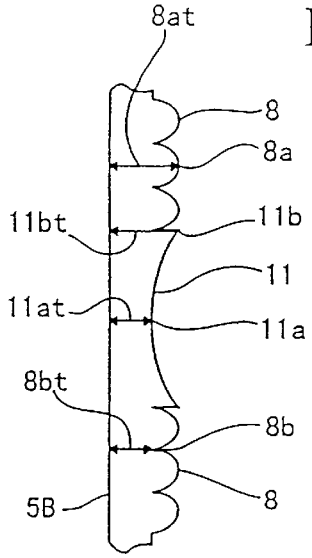

FIGS. 4A and 4B illustrate a third embodiment of the vehicular lamp of the present invention.

In the third embodiment, a lens 5B is formed of fish-eye lens portions 6B and cylindrical lens portions 7B which are alternately arranged. The fish-eye lens portion 6B is formed of a plurality of fish-eye lenses 8. Each fish-eye lens 8 is formed as a convex lens making a substantially semi-spherical projection. The cylindrical lens portion 7B is formed of a cylindrical lens 11 as a concave lens making a dome-shaped strip recess.

The thickness of each fish-eye lens portion 6B and each cylindrical lens portion 7B constituting the lens 5B is substantially equal. That is, the thickness 8*at* defined by the surface of the lens 5B and the top 8*a* of the fish-eye lens 8 of the fish-eye lens portion 6B is substantially equal to the thickness 11*bt* defined by the surface of the lens 5B and the boundary 11*b* (or 10*b*) between the fish-eye lens 8 and the cylindrical lens 11 adjacent thereto. Likewise, the thickness 8*bt* defined by the surface of the bottom 8*b* of the lens 5B and the boundary 8*bt* between adjacent fish-eye lenses 8 is substantially equal to the thickness 11*at* defined by the surface of the lens 5B and the bottom 11*a* of the cylindrical lens 11.

The third embodiment also provides a unique impression of the lighting image while preventing the generation of a dent in the shape of the lens 5B during formation.

Figure 5A:
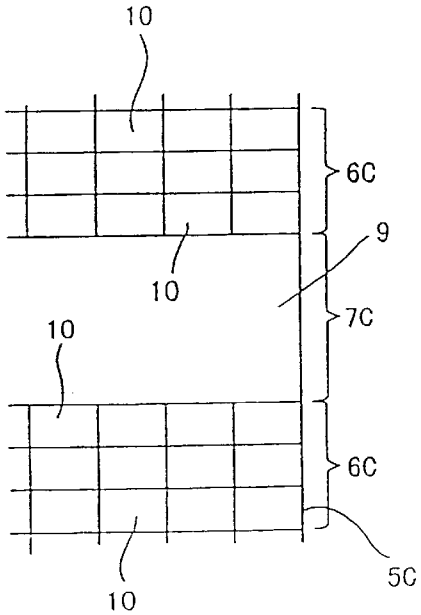
FIGS. 5A and 5B illustrate a fourth embodiment where
Figure 5B:
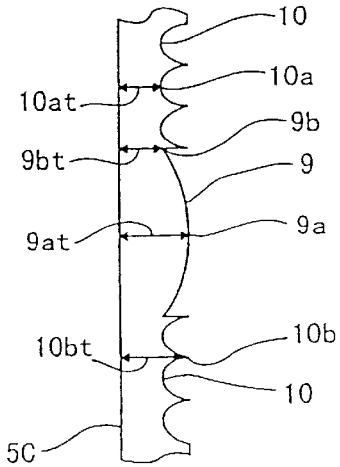

FIGS. 5A and 5B illustrate a fourth embodiment of a vehicular lamp of the present invention.

In the fourth embodiment, a lens 5C is formed of fish-eye lens portions 6C and cylindrical lens portions 7C which are alternately arranged. The fish-eye lens portion 6C is formed of a plurality of fish-eye lenses 10 as a concave lens each defining a semi-spherical recess. The cylindrical lens portion 7C is formed of a cylindrical lens 9 as a convex lens defining a substantially dome-shaped strip projection.

The thickness of each fish-eye lens portion 6C and each cylindrical lens portion 7C in the lens 5C is substantially equal. That is, the thickness 10*bt* defined by the surface of the lens 5C and a boundary 10*b* between adjacent fish-eye lenses 10 is substantially equal to the thickness 9*at* defined by the surface of the lens 5C and the top 9*a* of the cylindrical lens 9. The thickness 10*at* defined by the surface of the lens 5C and the bottom 10*a* of the fish-eye lens 10 is substantially equal to the thickness 9*bt* defined by the surface of the lens 5C and the boundary 9*b* between the fish-eye lens 10 and the cylindrical lens 9 adjacent thereto.

In the fourth embodiment, the present invention provides unique lighting image while preventing the generation of a dent in the shape of the lens 5C during formation.

Figure 6:
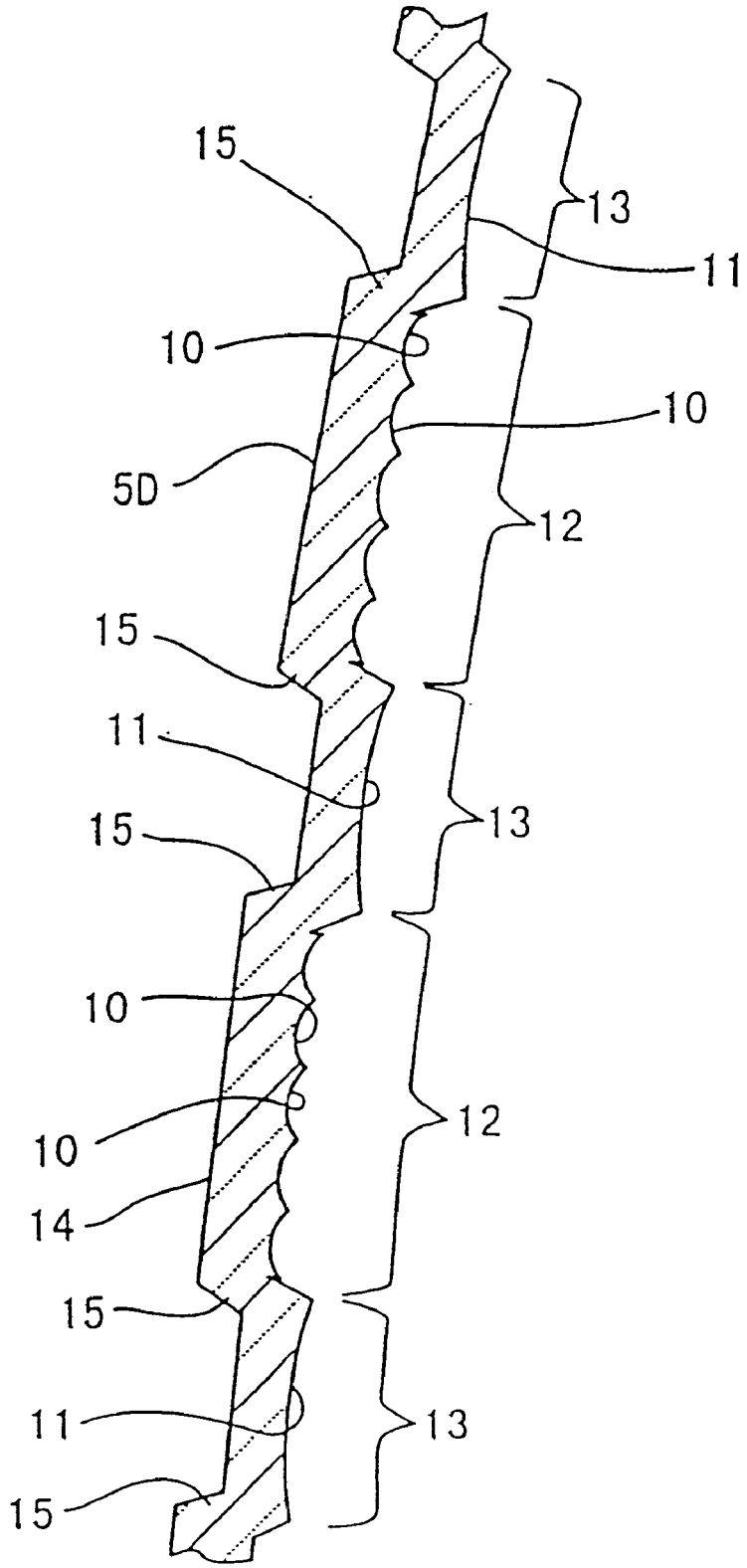
FIG. 6 is a vertical cross-sectional view of a lens of a fifth embodiment.
Figure 7:
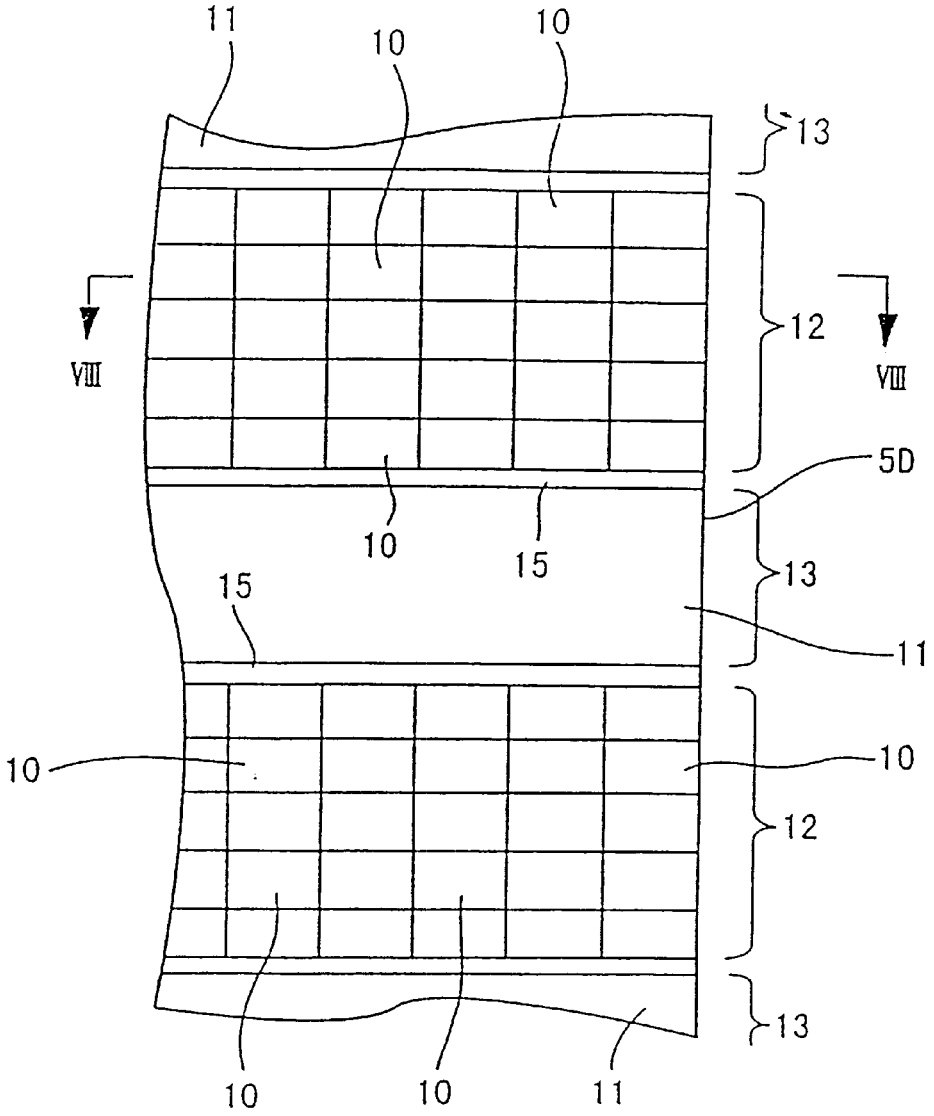
FIG. 7 is an enlarged rear elevation view of the lens of FIG. 6 illustrating an essential portion of the lens.
Figure 8:
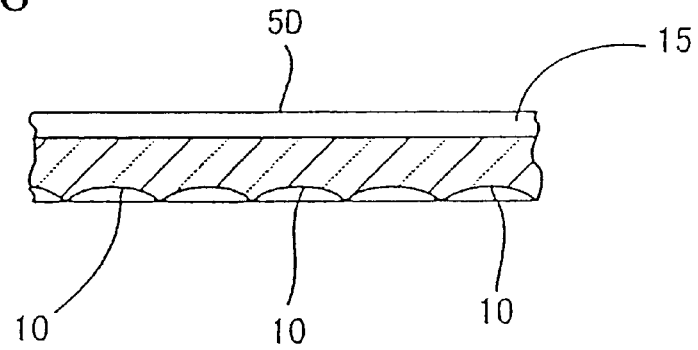
FIG. 8 is an enlarged cross-sectional view taken along the line VIII—VIII of FIG. 7.

FIGS. 6 to 8 illustrate a fifth embodiment of a vehicular lamp of the present invention.

A lens 5D of the fifth embodiment has fish-eye lens portions 12 and cylindrical lens portions 13 which are alternately arranged on its back surface. A connecting portion 15 that slants on a lens surface 14 is formed between the fish-eye lens portion 12 and the cylindrical lens portion 13 adjacent thereto. In this arrangement, the cylindrical lens portions 13 are shifted relative to the respective fish-eye lens portions 12 toward the bulb 3. The fish-eye lens portion 12 is formed of a plurality of concave fish-eye lenses 10 and the cylindrical lens portion 13 is formed of a concave cylindrical lens 11. Each of these fish-eye lens portions 12 and the cylindrical lens portions 13 is configured to have substantially equal thickness like the aforementioned respective embodiments.

Therefore, the fifth embodiment, like the aforementioned respective embodiments, provides unique lighting image while preventing the generation of a dent in the shape of the lens 5D during formation. Each boundary between the fish-eye lens portions 12 and the cylindrical lens portions 13 can be emphasized, thereby providing further unique lighting image.

In the embodiment illustrated in the drawing, the cylindrical lens portions 13 are shifted relative to the respective fish-eye lens portions 12 toward the bulb 3. However, the present invention may be configured inversely. That is, the cylindrical lens portions may be shifted relative to the fish-eye lens portions toward the lens. Further, in the fifth embodiment, each lens used as a fish-eye lens and a cylindrical lens for the fish-eye lens portions 12 and the cylindrical lens portions 13 is not limited to the concave lens. It is intended that the arbitrary combination described in the first to the fourth embodiments may be employed.

In a vehicular lamp including a light source disposed in a lamp chamber defined by a lamp body having a U-like recess portion with the open front and a lens covering the open front of the lamp body, the inner surface of the lens is formed of a fish-eye lens portion having a plurality of fish-eye lenses and a cylindrical lens portion having a cylindrical lens. Each thickness of the fish-eye lens portion and the cylindrical lens portion is substantially equal. Because the lens for the vehicular lamp of the present invention is formed of the fish-eye lens portion and the cylindrical lens portion, the respective light emitted through these portions may provide various images, thereby resulting in a unique impression. Because each thickness of the fish-eye lens portion and the cylindrical lens portion is substantially equal, the dent in the shape of the lens is prevented during formation of the lens.

In the second to the fifth embodiments of the present invention, the convex lens and the concave lens are combined in a predetermined manner to define the fish-eye lens constituting the fish-eye lens portion and the cylindrical lens constituting the cylindrical lens portion. The respective lighting images derived from the resultant fish-eye lens portion may vary, thereby enabling creation of desired images. In the sixth embodiment of the present invention, a connecting portion that slants on the lens surface connects the fish-eye lens portion and the cylindrical lens portion such that the cylindrical lens portion is shifted relative to the fish-eye lens portion toward the light source. The above arrangement may emphasize the boundary between the fish-eye lens portion and the cylindrical lens portion, thereby creating further unique lighting images.

It will be apparent to those skilled in the art that various modifications and variations can be made in the vehicular lamp of the present invention without departing from the spirit or scope of the invention. Thus, it is intended that the present invention cover the modifications and variations of this invention provided they come within the scope of the appended claims and their equivalents.

What is claimed is:

1. A vehicular lamp, comprising:

a lamp body having a bowl-shaped recess portion defining a lamp chamber and an opening;

a light source disposed in the lamp chamber;

a lens covering the opening of the lamp body, the lens having first and second lens surfaces;

a fish-eye lens portion formed of at least one fish-eye lens;

a cylindrical lens portion formed of at least one cylindrical lens, the fish-eye lens portion and the cylindrical lens portion arranged on the first lens surface with a maximum thickness of the fish-eye lens portion being substantially equal to a maximum thickness of the cylindrical lens portion.

2. The vehicular lamp according to claim 1, wherein:

the fish-eye lens portion and the cylindrical lens portion are connected at the first lens surface via a connecting portion that slants relative to the remainder of the first lens surface; and the cylindrical lens portion is shifted relative to the fish-eye lens portion toward or away from the light source.

3. The vehicular lamp according to claim 1, wherein:

the at least one fish-eye lens and the at least cylindrical lens is formed as a convex lens;

a thickness defined between the second lens surface and a top of the at least one fish-eye lens is substantially equal to a thickness defined between the second lens surface and a top of the at least one cylindrical lens; and a thickness of the lens at a boundary between adjacent fish-eye lenses is substantially equal to a thickness of the lens at a boundary between a fish-eye lens and a cylindrical lens adjacent thereto.

4. The vehicular lamp according to claim 3, wherein the at least one fish-eye lens defines a substantially semi-spherical shaped projection and the at least one cylindrical lens defines a dome-shaped strip projection.

5. The vehicular lamp according to claim 3, wherein:

the fish-eye lens portion and the cylindrical lens portion are connected at the first lens surface via a connecting portion that slants relative to the remainder of the first lens surface; and the cylindrical lens portion is shifted relative to the fish-eye lens portion toward or away from the light source.

6. The vehicular lamp according to claim 1, wherein:

the at least one fish-eye lens and the at least one cylindrical lens is formed as a concave lens;

a thickness of the lens at a boundary between adjacent fish-eye lenses is substantially equal to a thickness of the lens at a boundary between a fish-eye lens and a cylindrical lens adjacent thereto; and a thickness defined between the second lens surface and a bottom of the at least one fish-eye lens is substantially equal to a thickness defined between the second lens surface and a bottom of the at least one cylindrical lens.

7. The vehicular lamp according to claim 6, wherein the at least one fish-eye lens defines a substantially semi-spherical shaped recess and the at least one cylindrical lens defines a dome-shaped strip recess.

8. The vehicular lamp according to claim 6, wherein:

the fish-eye lens portion and the cylindrical lens portion are connected at the first lens surface via a connecting portion that slants relative to the remainder of the first lens surface; and the cylindrical lens portion is shifted relative to the fish-eye lens portion toward or away from the light source.

9. A vehicular lamp according to claim 1, wherein:

the at least one fish-eye lens is formed as a convex lens;

the at least one cylindrical lens is formed as a concave lens;

a thickness defined between the second lens surface and a top of the at least one fish-eye lens is substantially equal to a thickness of the lens at a boundary between a fish-eye lens and a cylindrical lens adjacent thereto; and a thickness of the lens at a boundary between adjacent fish-eye lenses is substantially equal to a thickness defined between the second lens surface and a bottom of the at least one cylindrical lens.

10. The vehicular lamp according to claim 9, wherein the at least one fish-eye lens defines a substantially semi-spherical shaped projection and the at least one cylindrical lens defines a dome-shaped strip recess.

11. The vehicular lamp according to claim 9, wherein:

the fish-eye lens portion and the cylindrical lens portion are connected at the first lens surface via a connecting portion that slants relative to the remainder of the first lens surface; and the cylindrical lens portion is shifted relative to the fish-eye lens portion toward or away from the light source.

12. A vehicular lamp according to claim 1, wherein:

the at least one fish-eye lens is formed as a concave lens;

the at least one cylindrical lens is formed as a convex lens;

a thickness of the lens at a boundary between adjacent fish-eye lenses is substantially equal to a thickness defined by the second lens surface and a top of the at least one cylindrical lens; and a thickness defined between the lens surface and a bottom of the at least one fish-eye lens is substantially equal to a thickness of the lens at a boundary between a fish-eye lens and a cylindrical lens adjacent thereto.

13. The vehicular lamp according to claim 12, wherein the at least one fish-eye lens defines a substantially semi-spherical shaped recess and the at least one cylindrical lens defines a dome-shaped strip projection.

14. The vehicular lamp according to claim 12, wherein:

the fish-eye lens portion and the cylindrical lens portion are connected at the first lens surface via a connecting portion that slants relative to the remainder of the first lens surface; and the cylindrical lens portion is shifted relative to the fish-eye lens portion toward or away from the light source.

15. The vehicular lamp according to claim 1, wherein the at least one fish-eye lens defines a substantially semi-spherical shaped projection and the at least one cylindrical lens defines a dome-shaped strip projection.

16. The vehicular lamp according to claim 1, wherein the at least one fish-eye lens defines a substantially semi-spherical shaped recess and the at least one cylindrical lens defines a dome-shaped strip recess.

17. The vehicular lamp according to claim 1, wherein the at least one fish-eye lens defines a substantially semi-spherical shaped projection and the at least one cylindrical lens defines a dome-shaped strip recess.

18. The vehicular lamp according to claim 1, wherein the at least one fish-eye lens defines a substantially semi-spherical shaped recess and the at least one cylindrical lens defines a dome-shaped strip projection.

19. The vehicular lamp according to claim 1, wherein the fish-eye lens portion and the cylindrical lens portion arranged on an inner surface of the lens.

20. A vehicular lamp, comprising:

a lamp body having a bowl-shaped recess portion defining a lamp chamber and an opening;

a light source disposed in the lamp chamber;

a lens covering the opening of the lamp body;

a fish-eye lens portion formed of at least one fish-eye lens;

a cylindrical lens portion formed of at least one cylindrical lens, the fish-eye lens portion and the cylindrical lens portion arranged on a maximum surface of the lens with a thickness of the fish-eye lens portion being substantially equal to a maximum thickness of the cylindrical lens portion.

* * * * *